US009280104B2

(12) United States Patent
Murakami

(10) Patent No.: US 9,280,104 B2
(45) Date of Patent: Mar. 8, 2016

(54) FIXING DEVICE AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/527,832

(22) Filed: Oct. 30, 2014

(65) Prior Publication Data

US 2015/0117881 A1 Apr. 30, 2015

(30) Foreign Application Priority Data

Oct. 31, 2013 (JP) ..... 2013-227217

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 20/2007; G03G 15/2007
See application file for complete search history.

(56) References Cited

U.S. PATENT DOCUMENTS

| | | | | |
|---|---|---|---|---|
| 7,437,090 | B2 * | 10/2008 | Soya | 399/67 |
| 7,623,817 | B2 * | 11/2009 | Jung et al. | 399/328 |
| 8,150,305 | B2 * | 4/2012 | Shin | 399/329 |
| 8,457,540 | B2 * | 6/2013 | Muramatsu et al. | 399/329 |

FOREIGN PATENT DOCUMENTS

| | | | |
|---|---|---|---|
| JP | 10319775 | A * | 12/1998 |
| JP | 2003-015463 | A | 1/2003 |
| JP | 2010113200 | A * | 5/2010 |
| JP | 2011059364 | A * | 3/2011 |
| JP | 2012013765 | A * | 1/2012 |

* cited by examiner

*Primary Examiner* — Clayton E Laballe
*Assistant Examiner* — Leon W Rhodes, Jr.
(74) *Attorney, Agent, or Firm* — Panitch Schwarze Belisario & Nadel LLP

(57) ABSTRACT

A fixing device according to the invention comprises a first belt in an endless form, a first heat source for heating the first belt, a first reflection member reflecting heat from the first heat source toward the first belt, and a first temperature detecting member for detecting temperature of the first reflection member by contacting the first reflection member, wherein the first reflection member is disposed between the first heat source and the first temperature detecting member. The fixing device is able to accurately detect the temperature of the member heated by the heat source.

12 Claims, 14 Drawing Sheets

FIXING DEVICE AND IMAGE FORMING APPARATUS

CROSS REFERENCE TO RELATED APPLICATION

This application claims priority benefits under 35 USC, section 119 on the basis of Japanese Patent Application No. 2013-227217, the disclosure of which is incorporated herein by reference.

BACKGROUND OF THE INVENTION

1. Field of the Invention

This invention relates to a fixing device and an image forming apparatus.

2. Description of Related Art

Fixing devices mounted on image forming apparatuses such as photocopiers, printers, facsimile machines employing electrophotographic methods, widely use thermally fixing methods. The fixing devices of the thermally fixing method generally have a fixing member and a pressure member forming a fixing nipping portion contacting each other with pressure and have a heating member incorporated in at least one of the fixing member and the pressure member. The fixing devices fixes unfixed toner images on a paper surface in application of heat and pressure when a paper carrying unfixed toner images passes the fixing nipping portion, A known publication, such as Japanese Patent Application Publication (A1) 2003-15463, discloses as a fixing device of a thermal fixing method, a device including a fixing roller incorporating a heater, a pressure roller contacting the fixing roller with pressure, a thermistor detecting a surface temperature of the fixing roller, a control means for controlling the heater to be turned on and off according to the detected value of the thermistor, and a thermostat serving as an excessive temperature rise prevention device disposed in not contact with the fixing roller to make power supply to the heater shut down based on an extraordinary temperature where the temperature of the fixing roller rises in an extraordinary way.

Where the fixing device employs such an excessive temperature rise prevention device stopping heat application from a heat source when it is detected that the temperature of the member heated by the heat source reaches a prescribed temperature, it is required that the temperature of the member heated by the heat source is detected accurately.

It is therefore an object of the invention to provide a fixing device and an image forming apparatus capable of detecting accurately a temperature of a member heated by a heat source.

SUMMARY OF THE INVENTION

As one aspect of the invention, a fixing device includes: a first belt in an endless form; a first heat source for heating the first belt; a first reflection member reflecting heat from the first heat source toward the first belt; and a first temperature detecting member for detecting temperature of the first reflection member by contacting the first reflection member, wherein the first reflection member is disposed between the first heat source and the first temperature detecting member.

As a second aspect of the invention, an image forming apparatus includes: an image forming section for forming a developer image on a recording medium; and the above mentioned fixing device for fixing, to the recording medium, the developer image formed on the recording medium.

BRIEF DESCRIPTION OF THE DRAWINGS

The above and other objects and features of the present invention will become apparent from the following detailed description and the appended claims with reference to the accompanying drawings.

FIG. 12A is a perspective view showing the fixing belt, and FIG. 12B is a cross-sectional diagram showing layers of the fixing belt;

FIG. 13A is a perspective view showing the drive roller, and FIG. 13B is a cross-sectional diagram showing layers of the drive roller;

FIG. 14A is a perspective view showing the drive roller, and FIG. 14B is a cross-sectional diagram showing layers of the driven roller;

FIG. 15A is a perspective view showing the reflection plate, and FIG. 15B is a cross-sectional diagram showing layers of the reflection plate;

DETAILED DESCRIPTION OF EMBODIMENTS

Figure 1:
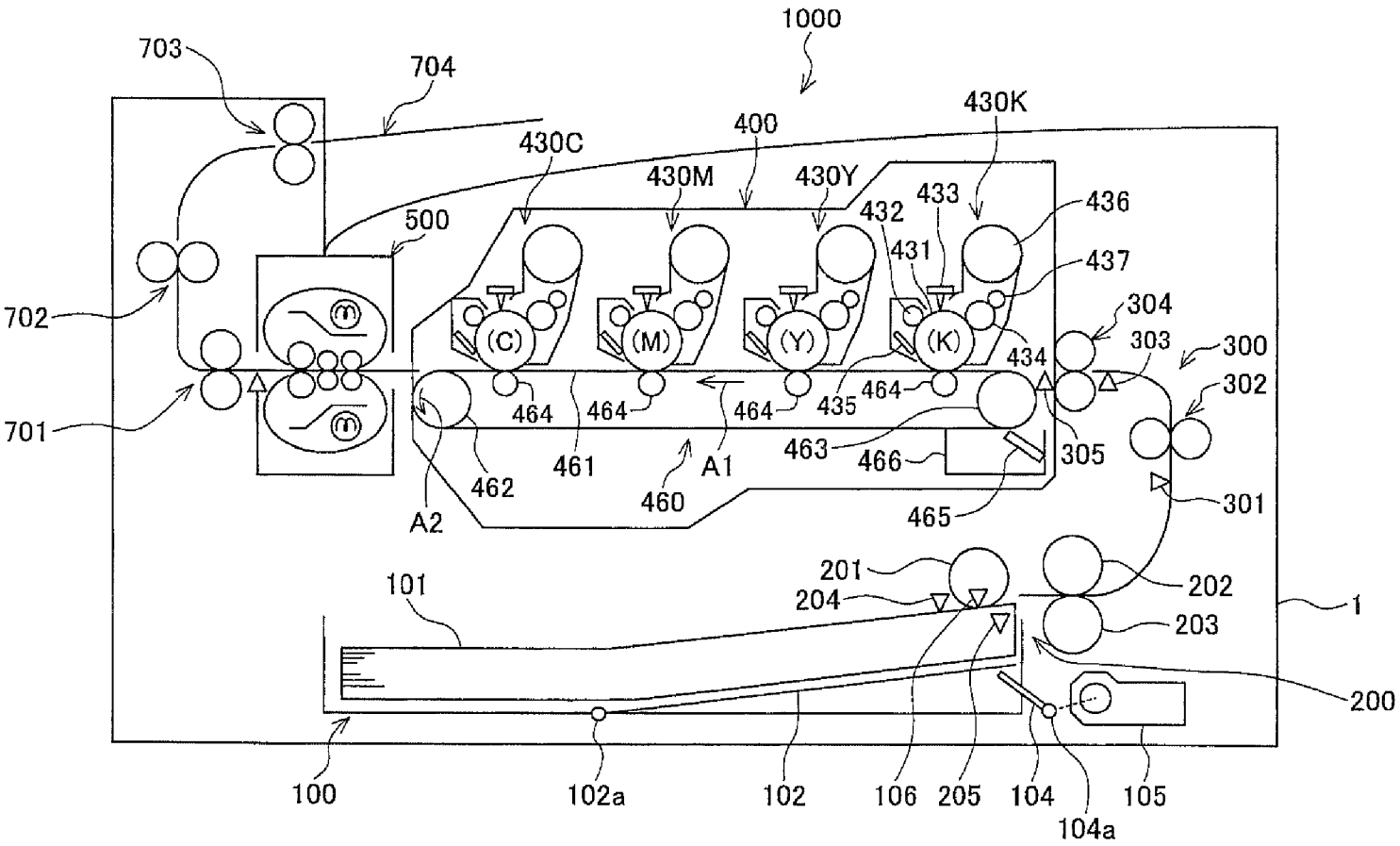
FIG. 1 is a schematic diagram showing an example of an image forming apparatus according to an embodiment of the invention.

Referring to the drawings, embodiments of affixing device and an image forming apparatus according to this invention are described.

FIG. 1 is a schematic diagram showing an example of an image forming apparatus 1000 according to an embodiment.

The image forming apparatus 1000 is an apparatus forming images by fixing developer images formed on a recording medium with a fixing device 500. More specifically, the image forming apparatus 1000 is a printing apparatus of an electrophotographic method and for multiple colors.

In FIG. 1, the image forming apparatus 1000 has a paper feeding tray 100 containing recording media 101 (hereinafter, referred to as simply "medium or media") such as paper. The paper feeding tray 100 is detachably attached to an apparatus body 1 of the image forming apparatus 1000. A medium loading plate 102 is provided in a way rotatable around the a support axis 102*a* inside the paper feeding tray 100, and the medium 101 is placed on the medium loading plate 102. A guide member, not shown, is provided to restrict a loading position of the medium 101. The guide member regulates a medium side edge portion in a direction perpendicular to a medium feeding direction (i.e., right direction in FIG. 1) and a medium portion in the medium feeding direction to be constant.

A lift up lever 104 is arranged in a way rotatable around a support axis 104*a* on a feeding side of the paper feeding tray 100, and the support axis 104*a* engages a motor 105 in a disengageable manner. When the paper feeding tray 100 is inserted into the apparatus body 1, the lift up lever 104 and the motor 105 come to engage one another to let a control unit 910 (see, FIG. 2) drive the motor 105. With this operation, a tip of the lift up lever 104 elevates up the bottom of the medium loading plate 102 as the lift up lever 104 rotates, thereby lifting up the media 101 stacked on the medium loading plate 102. If the media 101 reach a certain level, a rise detection unit 106 detects this, and the control unit 910 stops the motor 105 based on the detected information.

A medium feeding unit 200 is disposed on the feeding side of the medium feeding tray 100 for feeding the media 101 sheet by sheet out of the medium feeding tray 100. The medium feeding unit 200 incorporates a pickup roller 201 arranged in pressurized contact with the media 101 elevated to the certain level, and a pair of a feed roller 202 and a retard roller 203 for separating sheet by sheet the media fed by the pickup roller 201. The medium feeding unit 200 also incorporates a medium existence detection unit 204 for detecting as to whether the medium exists, and a medium remaining amount detection unit 205 for detecting a remaining amount of the media 101.

The medium 101 fed as one sheet from the medium feeding unit 200 is further fed to a medium conveyance unit 300. The medium 101 thus fed passes through a medium sensor 301 and is sent to a conveyance roller pair 302. The medium sensor 301 at that time notifies the control unit 910 of passage detection of the medium 101. The control unit 910 drives a drive unit 920 (see, FIG. 2) based on the notice from the medium sensor 301 to rotate the conveyance roller pair 302, thereby feeding the medium 101. More specifically, the control unit 910 begins rotation of the conveyance roller pair 302 at a timing in retarding a prescribed time from a timing that the medium 101 reaches the conveyance roller pair 302, based on the timing that the medium 101 passes by the medium sensor 301. With this operation, the medium 101 is pushed into the pressurized contact portion of the conveyance roller pair 302, thereby correcting skewing motion of the medium 301. The medium 101 fed with the conveyance roller pair 302 is sent to a conveyance roller pair 304 upon passing a medium sensor 303. The conveyance roller pair 304 is rotated by a drive unit 920 from a time point that the medium 101 passes by the medium sensor 303, and feeds the medium 101 without stopping. The medium 101 fed with the conveyance roller pair 304 is sent to an image forming unit 400 upon passing a writing sensor 305.

The image forming unit 400 is a portion forming developer images on the medium 101. The image forming unit 400 has four toner image forming units 430K, 430Y, 430M, 430C arranged in line along the conveyance direction of the medium 101, and a transfer unit 460. The toner image forming units 430K, 430Y, 430M, 430C form toner images as developer images. The transfer unit 460 transfers the toner images in respective colors formed with the toner image forming units 430K, 430Y, 430M, 430C according to Coulomb force onto the medium 101.

The toner image forming unit 430K includes a photosensitive drum 431 serving as an image carrier for carrying toner images, a charge roller 432 serving as a charge device for charging a surface of the photosensitive drum 431, an LED head 433 having a LED (Light Emitting Diode) array or arrays serving as a latent image forming device or an exposure device for forming electrostatic latent images on the charged surface of the photosensitive drum 431, and a developing roller 434 serving as a developer carrier for developing the electrostatic latent images with triboelectrically charged toners to form toner images. The toner image forming unit 430K further includes a supply roller 437 serving as a developer supply member for supplying toner to the developing roller 434, a serving unit 436 for supplying toner to the supply roller 437, and a cleaning blade 435 serving as a cleaning device for cleaning up the surface of the photosensitive drum 431. The structures of the toner image forming units 430Y, 430M, 430C are substantially the same as that of the toner image forming unit 430K except the toner color used, and therefore, any detail explanation is omitted.

The transfer unit 460 includes a transfer belt 461, a drive roller 462, a tension roller 463, four transfer rollers 464, a cleaning blade 465, and a toner box 466. The transfer belt 461 is an endless member electrostatically attaching the medium 101 and conveying the medium in a direction of Arrow A1 in FIG. 1. The drive roller 462 rotates in a direction of Arrow A2 in FIG. 1 as driven by the drive unit 920 to drive the transfer belt 461. The tension roller 463 provides tension to the transfer belt 461 with the drive roller 462. The four transfer rollers 464 are provided at each toner image forming unit, and each transfer roller 464 is disposed as to make pressurized contact to the corresponding photosensitive drum 431 in the toner image forming unit in sandwiching the transfer belt 461. Each transfer roller 464 is applied with a voltage for transferring the toner images on the photosensitive drum 431 onto the medium 101, from a power supply unit 930. The cleaning blade 465 cleans up the transfer belt 461 by scraping the toner attached to the transfer belt 461. The toner box 466 contains the toner scraped with the cleaning blade 465.

The toner image forming units 430K, 430Y, 430M, 430C and the transfer belt 461 are driven in a synchronous manner. The toner images in the respective colors formed with the respective image forming units are transferred sequentially in an overlapping manner on the medium 101 conveyed by the transfer belt 461 upon attached electrostatically. The medium 101 to which the toner images are thus transferred at the image forming unit 400 is sent to the fixing device 500.

The fixing device 500 melts or fixes, to the medium 101 in application of heat and pressure, the toner images formed on the medium 101. The medium 101 passing by the fixing device 500 is conveyed with delivery roller pairs 701, 702, 703 and delivered to a stacker unit 704.

Figure 2:
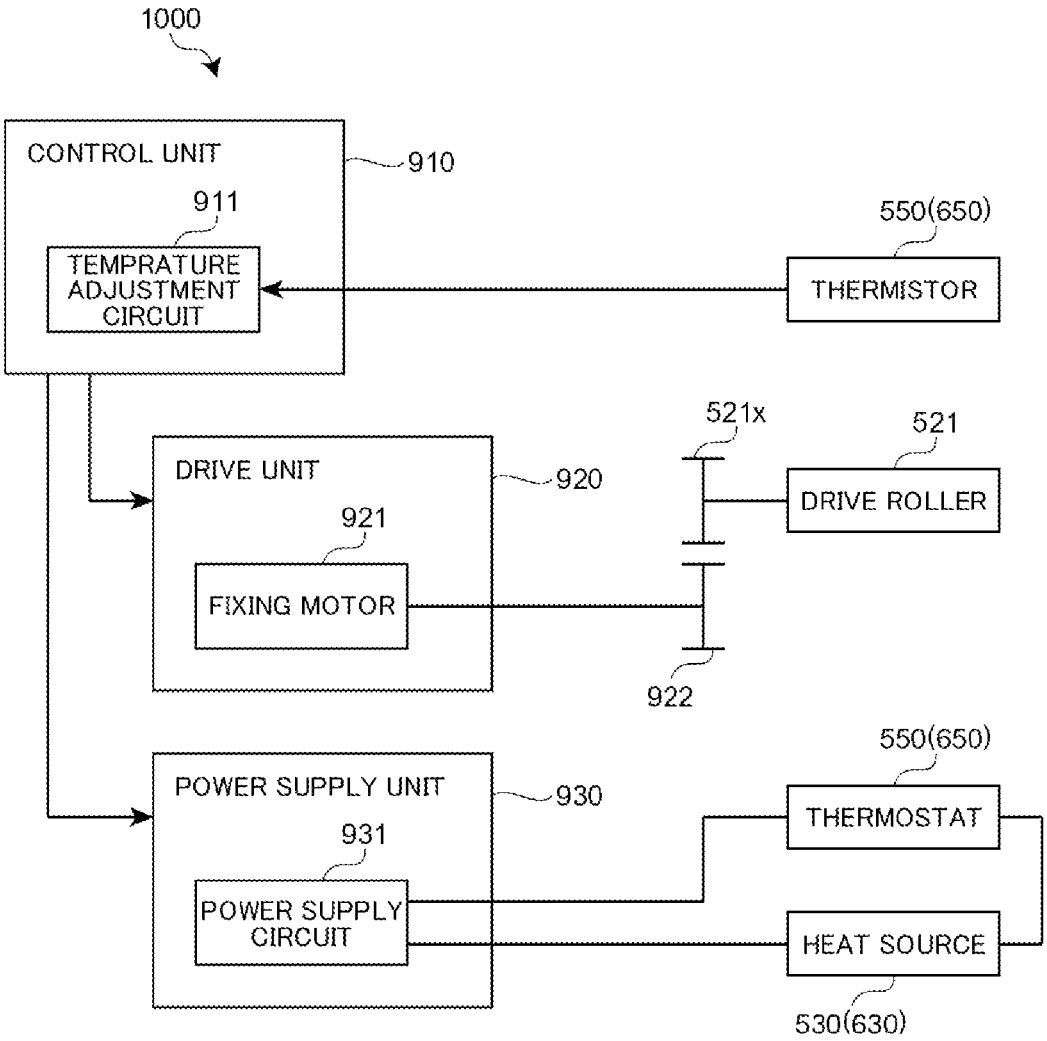
FIG. 2 is a block diagram showing a structure of a control system of the image forming apparatus according to the embodiment of the invention.

As shown in FIG. 2, the image forming apparatus 1000 includes the control unit 910, the drive unit 920, and the power supply unit 930. The control unit 910 includes, such as, e.g., a CPU (Central Processing Unit) and controls operation of the image forming apparatus 1000. The drive unit 920 includes such as a motor and provides drive force to, e.g., the toner image forming units 430K, 430Y, 430M, 430C, the transfer unit 460, and the fixing device 500 according to the instructions from the control unit 910. The power supply unit 930 supplies voltage or power to, e.g., the toner image forming units 430K, 430Y, 430M, 430C, the transfer unit 460, and the fixing device 500 according to the instructions from the control unit 910. For control of the fixing device 500, the control unit 910 has a temperature adjustment circuit 911; the drive unit 920 has a fixing motor 921; the power supply unit 930 has a power supply circuit 931.

Figure 3:
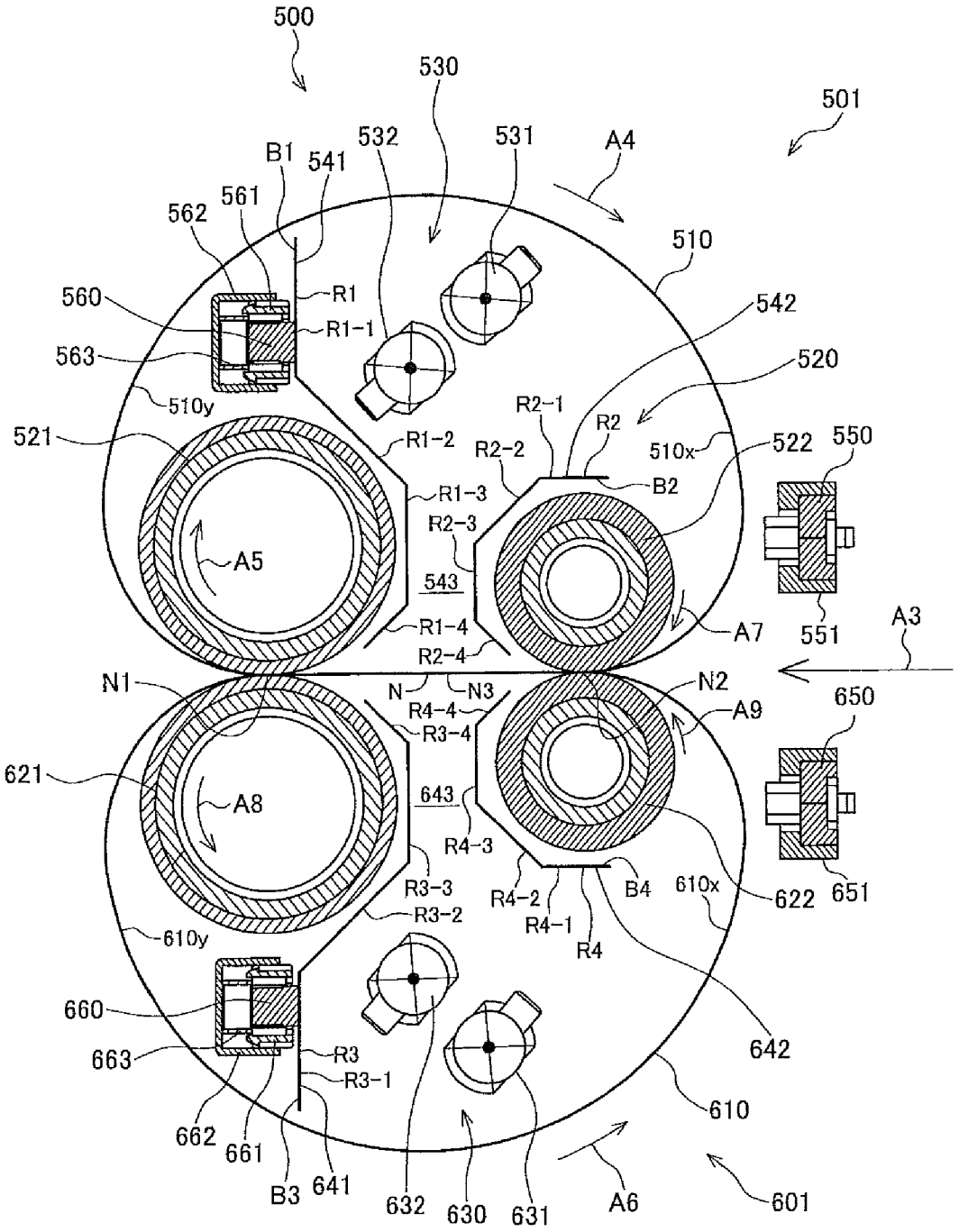
FIG. 3 is a schematic cross-sectional diagram showing a structure of a fixing device according to the embodiment.
Figure 4:
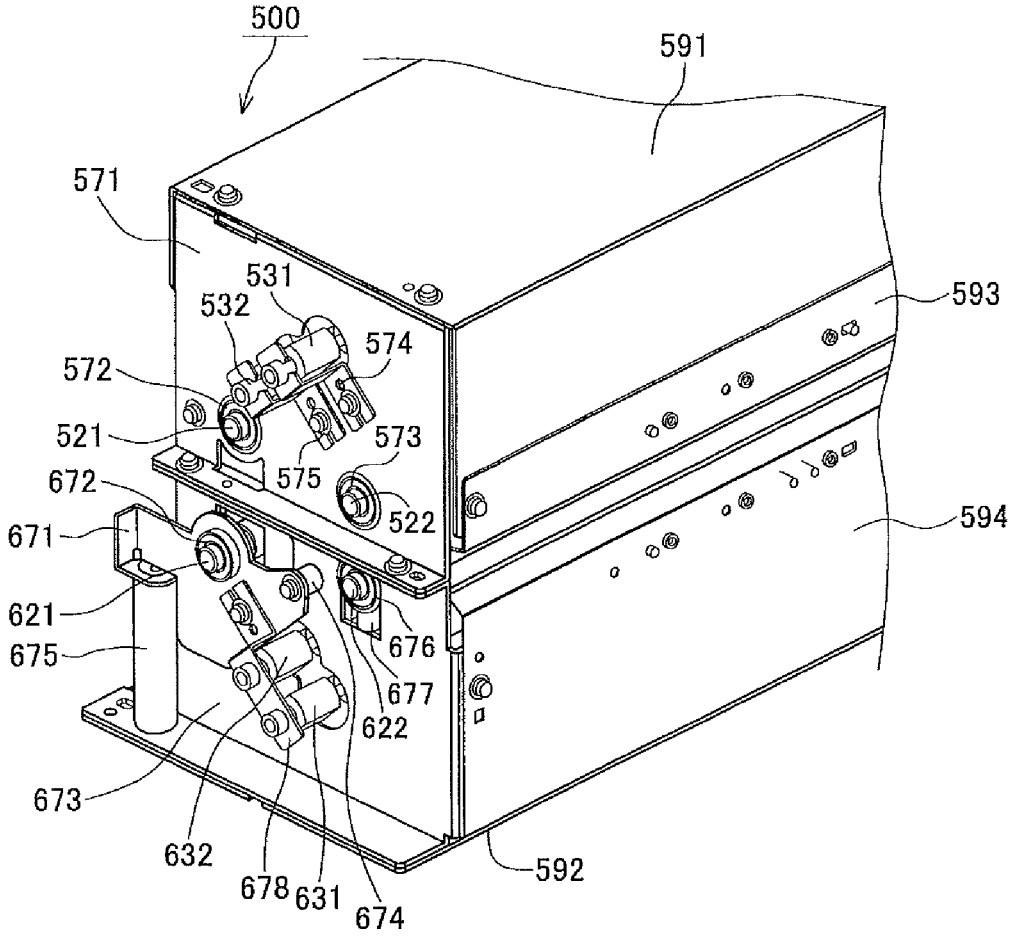
FIG. 4 is a perspective view showing a portion of the fixing device according to the embodiment.
Figure 5:
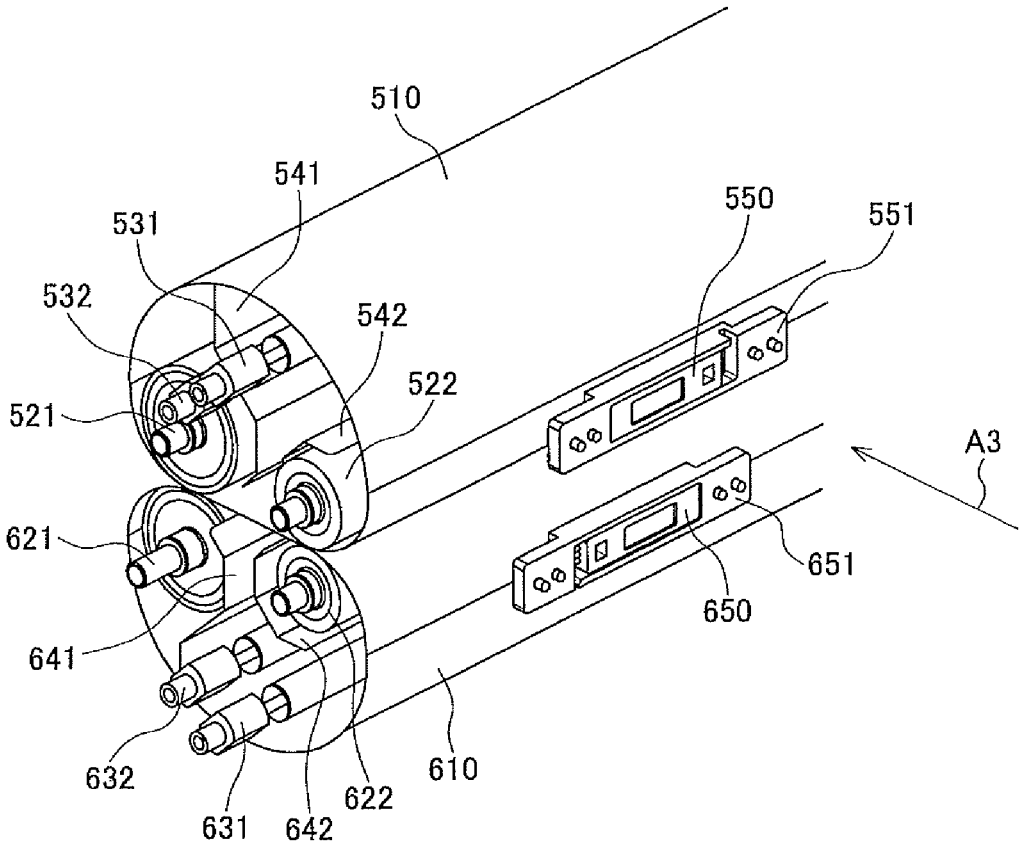
FIG. 5 is a perspective view showing a portion of the fixing device when seen from a medium loading side according to the embodiment.
Figure 6:
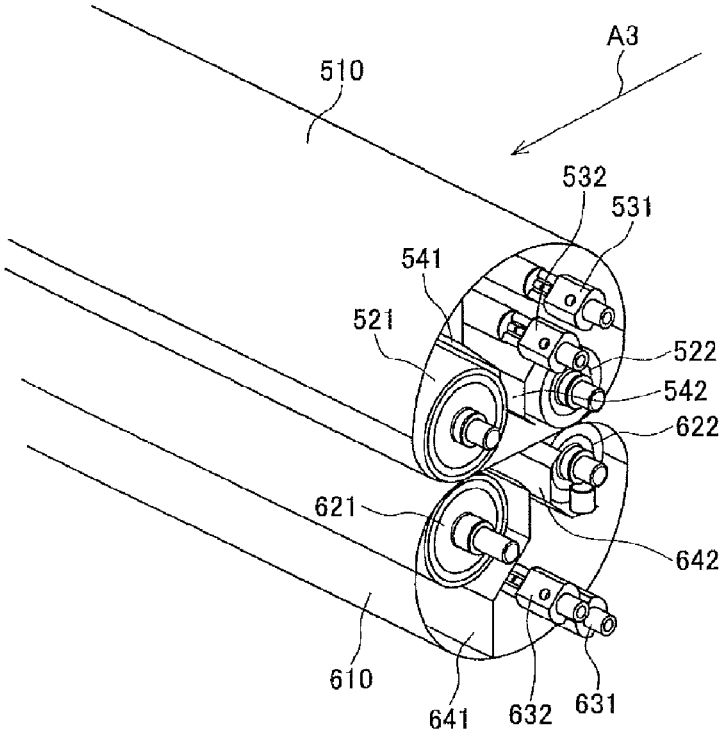
FIG. 6 is a perspective view showing a portion of the fixing device when seen from a medium delivery side according to the embodiment.
Figure 7:
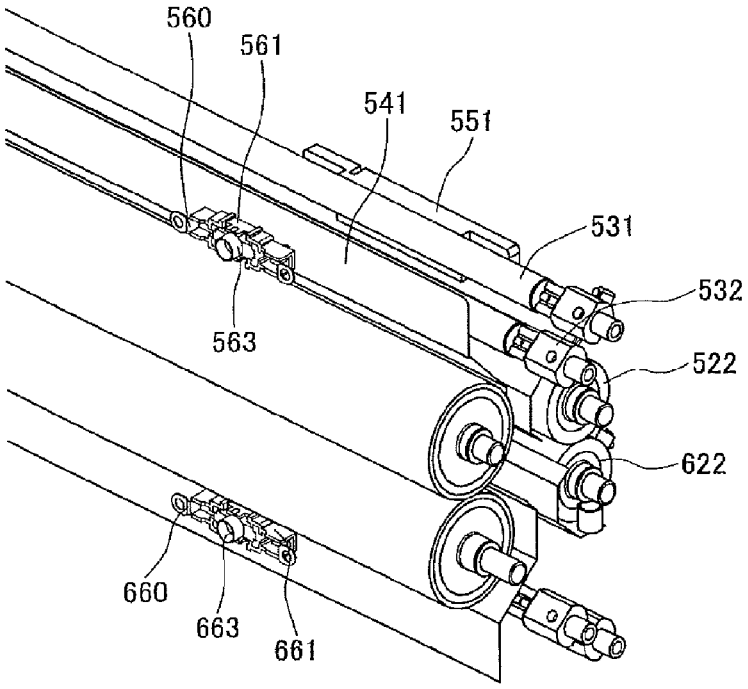
FIG. 7 is a perspective view showing a portion of the fixing device in a state that no belt is wound when seen from the medium delivery side according to the embodiment.

FIG. 3 is a schematic cross-sectional diagram showing a structure of the fixing device 500 according to this embodiment. FIG. 4 is a perspective view showing a portion of the fixing device 500; FIG. 5 is a perspective view showing a portion of the fixing device 500 when seen from a medium loading side; FIG. 6 is a perspective view showing a portion of the fixing device 500 when seen from a medium delivery side; FIG. 7 is a perspective view showing a portion of the fixing device 500 in a state that no belt is wound when seen from the medium delivery side. Referring to FIG. 3 to FIG. 7, the structure of the fixing device 500 is described.

The fixing device 500 has a fixing unit 501 and a pressure unit 601. The fixing unit 501 and the pressure unit 601 are disposed to face each other. The pressure unit 601 is urged toward the fixing device 501 and forms a nipping portion N between itself and the fixing device 501. The nipping portion N is a contact portion between the fixing device 501 and the pressure unit 601, and is also referred to as a fixing nipping portion. The medium 101 sent from the image forming unit 400 is delivered upon passing through the nipping portion N. The fixing unit 501 and the pressure unit 601 apply heat and pressure to unfixed toner images on the medium 101 at the nipping portion N at that time, thereby fixing the toner images to the medium 101.

Respective members of the fixing unit 501 and the pressure unit 601 are attached to a frame of the fixing device 500. As shown in FIG. 4, the frame of the fixing device 500 is structured of an upper frame 591, a lower frame 592, brackets 571, 673, and entrance guides 593, 594.

As shown in FIG. 3, the fixing unit 501 includes a fixing belt 510 serving as a fixing member or a first belt, a support unit 520, and a heat source 530 as a first heat source.

The fixing belt 510 is an endless member. The fixing belt 510 moves along a medium conveyance direction (Arrow A3 direction in FIG. 3) as a direction conveying the medium 101, and provides heat to the unfixed toner on the conveyed medium 101. More specifically, the fixing belt 510 is disposed in a rotatable manner and moves in rotating in a prescribed rotational direction (Arrow A3 direction in FIG. 3). The fixing belt 510 extends in a longitudinal direction perpendicular to the medium conveyance direction, i.e., the direction perpendicular to the cross section of FIG. 3. The fixing belt 510 has an elasticity.

The support unit 520 is disposed inside the fixing belt 510 and supports the fixing belt 510 to guide the motion of the fixing belt 510. In this embodiment, the support unit 520 includes a drive roller 521 as a first support roller and a driven roller 522 as a second support roller. The drive roller 521 and the driven roller 522 are disposed as separated from each other in the moving direction of the fixing belt 510 and disposed in a manner rotatable in contact with an inner peripheral surface of the fixing belt 510, respectively. The drive roller 521 is placed on a downstream side of the drive roller 522 in the medium conveyance direction, while the driven roller 522 is placed on an upstream side. The drive roller 521 drives and conveys the fixing belt 510. The driven roller 522 is driven to rotate according to the rotation of the fixing belt 510. If a distance between centers of both rollers is defined as a maximum distance between the centers where the fixing belt 510 is tensioned without loosen by means of the drive roller 521 and the driven roller 522, the drive roller 521 and the driven roller 522 are so arranged that the distance between the centers of both rollers is shorter than the maximum distance between the centers. In other words, the fixing belt 510 is provided not being tensioned without loosen by means of the drive roller 521 and the driven roller 522 but being in a free state or a loosen state around both rollers. The drive roller 521 and the driven roller 522 are disposed so that rotary axes of the respective rollers are placed parallel to the longitudinal direction of the fixing belt 510. As shown in FIG. 4, the drive roller 521 is supported at its axis in a rotatable manner at each end in a direction of the rotation axis via a bearing 572 to the bracket 571. Similarly, the driven roller 522 is supported at its axis in a rotatable manner at each end in a direction of the rotation axis via a bearing 573 to the bracket 571. As shown in FIG. 2, a gear 521*x* is formed unitedly with the drive roller 521 at one end in the rotation axis direction of the drive roller 521. The gear 521*x* engages a driving gear 922 attached to an output axis of the fixing motor 921. The drive roller 521 receives drive force from the fixing motor 921 through the gears 922, 521*x*, and rotates in a prescribed direction, i.e., Arrow A5 direction in FIG. 3.

The heat source 530 is a heat application source for heating the fixing belt 510. In this embodiment, the heat source 530 has two heaters 531, 532 disposed inside the fixing belt 510. The reason for using the two heaters is to change a heating profile according to a medium size in the width direction, i.e., a direction perpendicular to the medium conveyance direction, which is parallel to the printing surface of the medium 101. Halogen lamps may be used for the heaters 531, 532. The heaters 531, 532 are arranged as extending in the longitudinal direction of the fixing belt 510, and, as shown in FIG. 4, are supported at each end thereof with heater support portions 574, 575 arranged at the bracket 571. It is to be noted that the number of the heaters may be one or three or more. The kind of the heat source is not limited to the halogen lamp, but can be, such as, e.g., an induced heater. As shown in FIG. 2, the heat source 530 is connected to the power supply circuit 931, and generates heat upon receiving power from the power supply circuit 931.

The pressure unit 601 contacts with pressure to the support unit 520 in sandwiching the fixing belt 510, or sandwiches the fixing belt 510 with the support unit 520, and forms the nipping portion N between itself and the fixing belt 510. In this embodiment, the pressure unit 601 includes a pressure belt 610 serving as a second belt, a pressure roller 621 serving as a pressure member or a first pressure roller, and a pressure roller 622 serving as a pressure member or a second pressure roller.

The pressure belt 610 is an endless member and is disposed as facing the fixing belt 510. The pressure belt 610 moves along the medium conveyance direction and conveys the medium 101 in nipping the medium 101 with the fixing belt 510. More specifically, the pressure belt 610 is disposed as rotatable and moves as rotating in a prescribed rotational direction, i.e., Arrow A6 direction in FIG. 3. The pressure belt 610 extends in a longitudinal direction along the longitudinal direction of the fixing belt 510. The pressure belt 610 has an elasticity.

The pressure roller 621 contacts with pressure to the drive roller 521 in nipping the fixing belt 510 and the pressure belt 610 and forms a first nipping portion N1 between the fixing belt 510 and the pressure belt 610. The first nipping portion N1 is a portion sandwiched between the drive roller 521 and the pressure roller 621 in the nipping portion N.

The pressure roller 622 contacts with pressure to the driven roller 522 in nipping the fixing belt 510 and the pressure belt 610 and forms a second nipping portion N2 between the fixing belt 510 and the pressure belt 610. The second nipping portion N2 is a portion sandwiched between the driven roller 522 and the pressure roller 622 in the nipping portion N.

The pressure rollers 621, 622 are disposed in a manner separating from each other in the moving direction of the pressure belt 610, and disposed as rotatable in contact with the inner peripheral surface of the pressure belt 610, respectively. The pressure roller 621 is placed on a downstream side, in the medium conveyance direction, while the pressure roller 622 is placed on an upstream side. The pressure rollers 621, 622 are driven to rotate according to the rotation of the pressure belt 610. If a distance between centers of both rollers is defined as a maximum distance between the centers where the pressure belt 610 is tensioned without loosen by means of the pressure roller 621 and the pressure roller 622, the pressure roller 621 and the pressure roller 622 are so arranged that the distance between the centers of both rollers is shorter than the maximum distance between the centers. In other words, the pressure belt 610 is provided not being tensioned without loosen by means of the pressure roller 621 and the pressure roller 622 but being in a free state or a loosen state around both rollers. The pressure roller 621 and the pressure roller 622 are disposed so that rotary axes of the respective rollers are placed parallel to the longitudinal direction of the pressure belt 610. As shown in FIG. 4, the pressure roller 621 is supported at its axis in a rotatable manner at each end in a direction of the rotation axis via a bearing 672 to a pressure roller lever 671. The pressure roller lever 671 is supported around an axial member 674 to a bracket 673 so as to move pivotally, and is urged toward the drive roller 521 by a spring 675 serving as an urging member. With this mechanism, the pressure roller 621 is pushed at prescribed pressing force to the drive roller 521 in nipping the pressure belt 610 and the fixing belt 510, thereby pushing the medium 101 to a side of the drive roller 521. The pressure roller 622 is supported at its axis in a rotatable manner at each end in the rotation axis direction via a bearing 676 to a bracket 673. The bearing 676 is supported to the bracket 673 in being movable in a direction contacting the pressure roller 622 and the driven roller 522, and the pressure roller 622 is urged toward the driven roller 522 by the spring 677.

As shown in FIG. 3, the pressure belt 610 contacts the fixing belt 510 between the first nipping portion N1 and the second nipping portion N2 and forms a third nipping portion N3. The pressure unit 601 forms the nipping portion N including the first nipping portion N1, the second nipping portion N2, and the third nipping portion N3, between itself and the fixing belt 510.

In this embodiment, when seen from the longitudinal direction of the fixing belt 510, the first nipping portion N1 and the second nipping portion N2 are aligned in a line, e.g., the same horizontal line, and the nipping portion N extends straight, thereby forming a straight medium conveyance unit. With this structure, the fixing belt 510 and the pressure belt 610 do not have an acute curvature, so that any stress due to an acute curvature may not be exerted to the belts. For example, if a pad method is used, a belt may be folded at each end of the nipping portion, so that a belt may receive some stress.

The fixing device 500, on a side of the fixing unit 510, includes a reflection plate 541 serving as first and second reflection members, a reflection plate 542 serving as a third reflection plate, a thermistor 550 serving as a temperature detection member, and a thermostat 560 serving as a first temperature detecting member. In one exemplary embodiment of the present invention, the temperature detecting member may be an excessive temperature rise prevention member disposed in contact with the reflection plate 541 for ceasing heating from the heat source 530 in a case where detecting that a temperature of the reflection plate 541 reaches a prescribed temperature.

The reflection plates 541, 542 are members reflecting heat or light from the heat source 530 toward the fixing belt 510. The reflection plates 541, 542 are disposed as facing the heat source 530.

The reflection plate 541 is structured so as to reflect the heat from the heat source 530 toward an upstream region of the nipping portion N in the moving direction (or conveyance direction) of the fixing belt 510 in a range of the fixing belt 510. More specifically, the reflection plate 541 is disposed so as to divide the fixing belt 510, with respect to the rotational direction of the fixing belt 510, into a region 510*x* on an upstream side of the nipping portion N and a region 510*y* on a downstream side of the nipping portion N, and is structured as to reflect the heat from the heat source 530 toward the region 510*x* on the upstream side. The reflection plate 541 is structured so as to reflect the heat more to a portion near the nipping portion N, in the moving direction of the fixing belt 510, in comparison with a situation that no reflection plate is provide. The reflection plate 541 is structured as to reflect the heat from the heat source 530 toward the upstream side in the medium conveyance direction. The reflection plate 541 extends in, e.g., the longitudinal direction of the fixing belt 510, and is secured to the bracket 571 at each end thereof.

The reflection plate 541 is disposed between the heat source 530 and the drive roller 521 and cuts off the heat from the heat source 530 to the drive roller 521. More specifically, the reflection plate 541 covers the surface of the drive roller 521 so that a rubber portion of the drive roller 521 as a surface layer is not directly exposed to radiation heat emitted from the heat source 530.

The reflection plate 542 is disposed between the heat source 530 and the driven roller 522 and cuts off the heat from the heat source 530 to driven roller 522. More specifically, the refection plate 542 covers the surface of the drive roller 522 so that a rubber portion of the driven roller 522 as a surface layer is not directly exposed to radiation heat emitted from the heat source 530.

The reflection plates 541, 542 are disposed at positions not contacting the drive roller 521 and the driven roller 522 in consideration with such as thermal expansion and rotational vibration of the drive roller 521 and the driven roller 522, respectively.

The reflection plates 541, 542 are disposed as separated in the moving direction of the fixing belt 510 and the medium conveyance direction in having a prescribed space, and forms a route 543 introducing the heat from the heat source 530 into the third nipping portion N.

The reflection plate 541 has a reflection surface R1 reflecting the heat from the heat source 530, and a back surface (or namely, non-reflection surface) B1 located on the opposite side of the reflection surface R1. The reflection plate 542 has a reflection surface R2 reflecting the heat from the heat source 530 and a back surface (or namely, non-reflection surface) B2 located on the opposite side of the reflection surface R2.

Referring to FIG. 3, a specific example of the reflection plates 541, 542 is described. In the following description, a straight line coinciding to the nipping portion N when seen in the longitudinal direction of the fixing belt 510 is referred to as "nipping reference line." The nipping reference line extends, e.g., horizontally. A direction on a side of the fixing unit 501 is defined as an upper direction whereas a direction on a side of the pressure unit 601 is defined as a lower direction.

The reflection surface R1 of the reflection plate 541 has four reflection surfaces R1-1 to R1-4, while the reflection surface R2 of the reflection plate 542 has four reflection surfaces R2-1 to R2-4. Each of those reflection surfaces R1-1 to R1-4, R2-1 to R2-4 is in a plane shape.

The reflection surface R1-3 and the reflection surface R2-3 extend in a direction perpendicular to the nipping reference line and are disposed as facing each other. The reflection surface R1-3 and the reflection surface R2-3 are disposed in parallel to each other as to introduce light entering between these surfaces into the nipping portion N upon reflecting the light between these surfaces.

The reflection surface R1-2 is disposed between the heat source 530 and the drive roller 521. The reflection surface R1-2 extends obliquely upward on a downstream side in the medium conveyance direction from an upper end of the reflection surface R1-3, and is inclined with an angle 45 degrees with respect to the reflection surface R1-3. The reflection surface R1-1 extends upward from an end of the reflection surface R1-2 on a downstream side in the medium conveyance direction. The reflection surface R1-4 extends obliquely downward on a downstream side in the medium conveyance direction from a lower end of the reflection surface R1-3 and is inclined with an angle 45 degrees with respect to the reflection surface R1-3.

The reflection surface R2-2 is disposed between the heat source 530 and the driven roller 522. The reflection surface R2-2 extends obliquely upward on a downstream side in the medium conveyance direction from an upper end of the reflection surface R2-3, and is inclined with an angle 45 degrees with respect to the reflection surface R2-3. The reflection surface R2-1 extends parallel to the nipping reference line on the upstream side in the medium conveyance direction from an end of the reflection surface R2-2 on the upstream side in the medium conveyance direction, and is inclined with an angle 45 degrees with respect to the reflection surface R2-2. The reflection surface R2-4 extends obliquely downward on an upstream side in the medium conveyance direction from a lower end of the reflection surface R2-3 and is inclined with an angle 45 degrees with respect to the reflection surface R2-3.

The thermistor 550 is a temperature sensor detecting surface temperature of the fixing belt 510, and is used for keeping the surface temperature of the fixing belt 510 at an appropriate temperature for fixing. The thermistor 550 is disposed as facing the fixing belt 510 in a state ensuring a prescribed gap, or namely in a non-contact state with the belt. With the structure that the thermistor is disposed in contact with the surface of the fixing belt, such a thermistor gives damages to the surface of the fixing belt and makes the surface worn as time goes, thereby making those appear on printing images. In this embodiment, the thermistor 550 is disposed in non-contact with the belt, so that such image failure can be avoided. The thermistor 550 is arranged in a region through which media in all sizes handled by the image forming apparatus 1000 can pass. As shown in FIGS. 3, 4, the thermistor 550 is secured to a holder 551. The holder 551 is secured to the upper frame 591. As shown in FIG. 2, the thermistor 550 is connected to the temperature adjustment circuit 911.

The thermostat 560 is disposed in contact with the reflection plate 541, and is a member stopping heat application of the heat source 530 when it is detected that the temperature of the reflection plate 541 reaches a prescribe temperature. The thermostat 560 is provided to prevent the fixing device 500 from extraordinally generating heat. More specifically, the thermostat 560 cuts off the power to the heat source when it is detected that the temperature of the reflection plate 541 reaches a prescribe temperature. As shown in FIG. 2, the thermostat 560 is disposed at an interconnection between the heat source 530 and the power supply circuit 931, and when the temperature of the thermostat 560 reaches a prescribe power cutoff temperature (or operation temperature), the thermostat 560 enters into an open state to cut off the power supply to the heat source 530.

In this embodiment, the thermostat 560 is disposed in contact with the back surface B1 of the reflection plate 541. The thermostat 560 is disposed on the opposite side to the heat source 530 with respect to the reflection plate 541. The thermostat 560 is disposed at a position facing a region of the fixing belt 510 (i.e., region 510*y*) on a downstream side of the nipping portion N in the moving direction of the fixing belt 510. The thermostat 560 is disposed on the downstream side of the heat source 530 in the medium conveyance direction. For example, the thermostat 560 is disposed on a downstream side in the medium conveyance direction as possible with respect to the heat source 530 and at a position at which a heat radiation area to the fixing belt 510 becomes wider as much as possible.

The thermostat 560 is disposed within a heat generation area of all heaters in the heat source 530, or namely within a region in which the heat generation areas of all heaters are overlapping. The thermostat 560 may be placed at a position at which heat distribution of the heat source 530 becomes the highest amount. The thermostat 560 is disposed within a region at which media in all sizes handled by the image forming apparatus 1000 can pass with respect to the width direction of the media.

Figure 8:
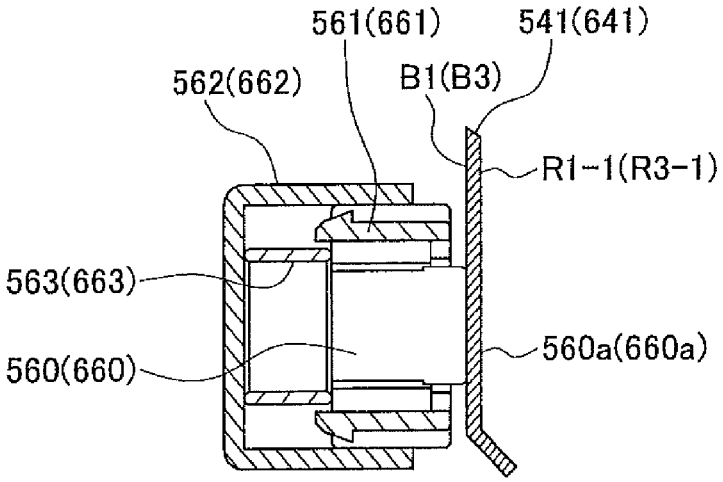
FIG. 8 is a cross section showing an installation structure of a thermostat according to the embodiment.
Figure 9:
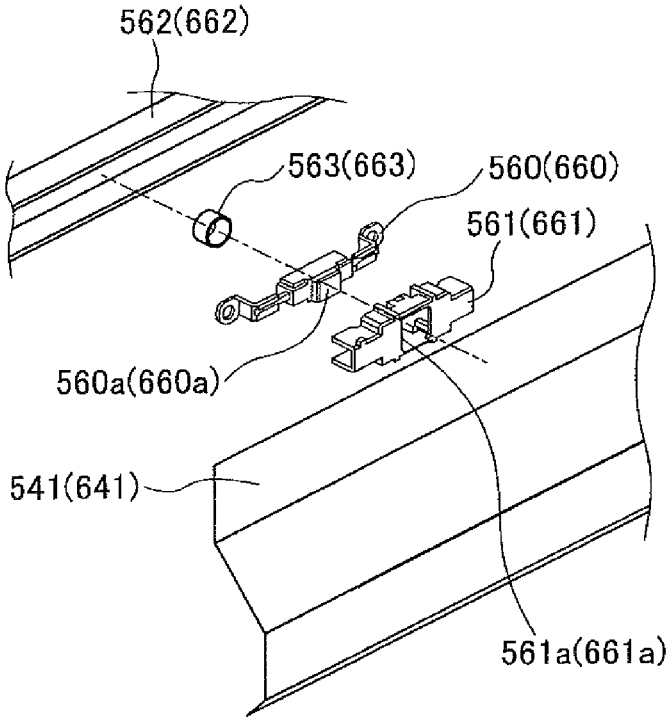
FIG. 9 is a perspective view showing the installation structure of the thermostat according to the embodiment.

FIG. 8 and FIG. 9 are a cross section and a perspective view showing the installation structure of the thermostat 560. The thermostat 560 is secured to the holder 561 made of a non-conductive resin. The holder 561 is supported to a thermostat support member 562 so that a heat sensing surface 560*a* of the thermostat 560 faces the back surface B1 of the reflection plate 541. The heat sensing surface 560*a* of the thermostat 560 at that time faces the back surface B1 upon projecting from an opening 561*a* formed in the holder 561. The thermostat support member 562 extends, e.g., along the longitudinal direction of the reflection plate 541 and secured to the bracket 571 at each end. To surely contact the thermostat 560 with the back surface B1, an urging member 563 such as a coil spring is disposed between the thermostat support member 562 and the thermostat 560. The thermostat 560 is urged toward the reflection plate 541 by the urging member 563, so that the heat sensing surface 560*a* of the thermostat 560 is pushed to the back surface B1.

Figure 10:
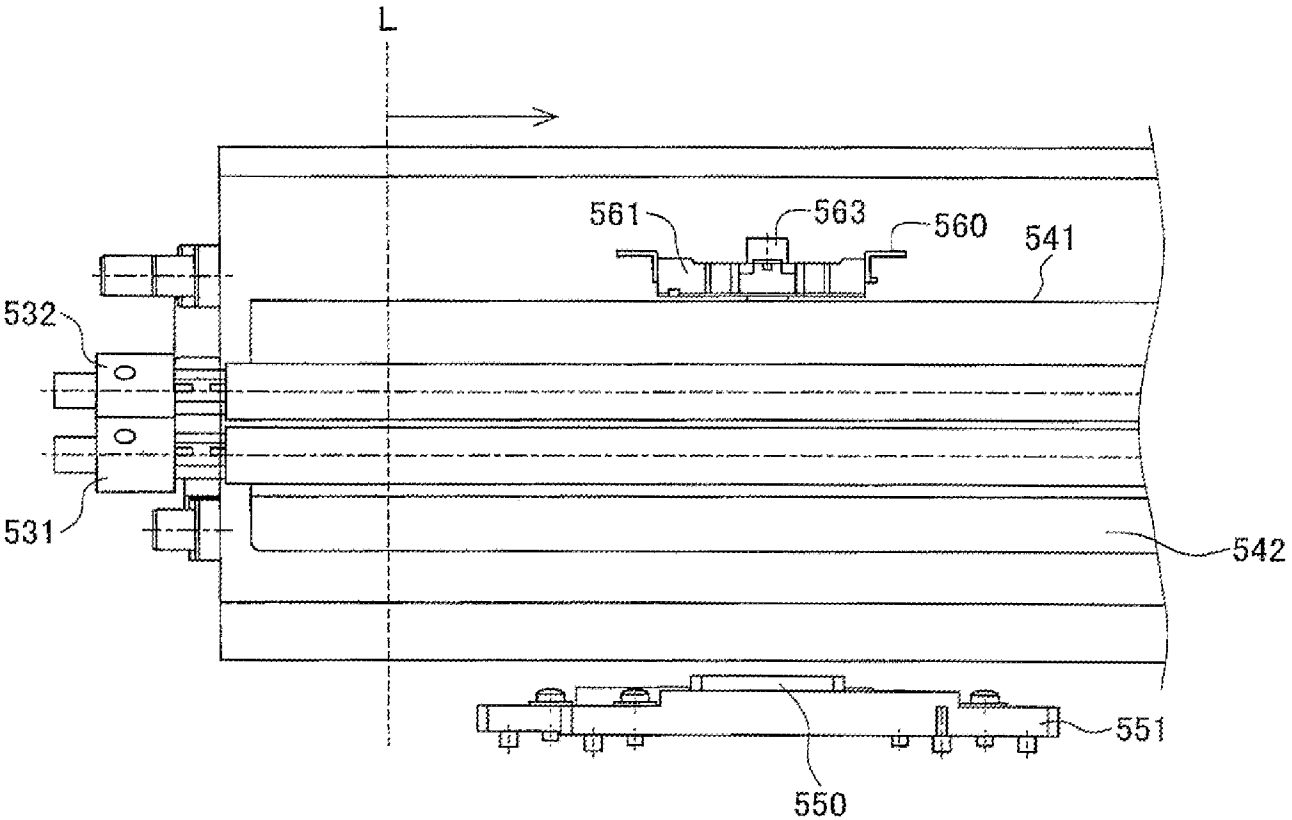
FIG. 10 is a diagram showing a positional relationship between a medium proceeding region and the thermostat according to the embodiment.

FIG. 10 is a diagram showing a positional relationship between a medium proceeding region and the thermostat 560. In FIG. 10, a broken line L shows medium proceeding reference. In this embodiment, the medium proceeding reference L is set to one end side (left end side in FIG. 10) of the fixing device 500 in the width direction of the medium, and all media regardless of their size should be conveyed in a way that one end on a one side (on the left side in FIG. 10) coincides to the medium proceeding reference L. The thermostat 560 is disposed within the region through which all media in any size pass, in the width direction of the medium, and more specifically, the thermostat 560 is placed at an end of the fixing device 500 on a side of the medium proceeding reference.

Figure 11:
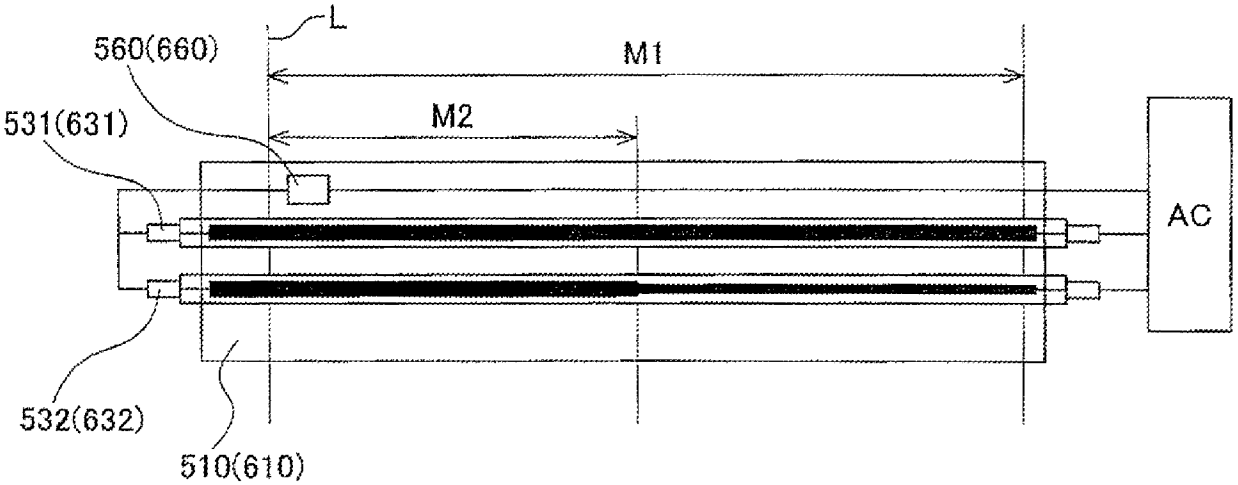
FIG. 11 is a diagram showing a positional relationship among a light emitting region of a heater, the medium proceeding region, and the thermostat according to the embodiment.

FIG. 11 is a diagram showing a positional relationship among light emitting (i.e., heat generating) regions of the heaters 531, 532, the medium proceeding region, and the thermostat 560. In FIG. 11, the proceeding region M1 indicates a region through which a medium having the maximum size handled by the image forming apparatus 1000 passes, and the proceeding region M2 indicates a region through which a medium having a half of the maximum size passes. The heater 531 corresponds to a medium having a wide width, has a long light emitting length corresponding to the proceeding region M1, and has a light emitting region slightly wider than the proceeding region M1. The heater 532 corresponds to a medium having a narrow width, has a short light emitting length corresponding to the proceeding region M2, and has a light emitting region slightly wider than the proceeding region M2. In the width direction of the medium, the thermostat 560 is disposed in a region at which the light emitting region of the heater 531 and the light emitting region of the heater 532 overlap each other.

As shown in FIG. 3, the support unit 520, the thermostat 560, the reflection plate 541, and the heat source 530 are arranged to face the fixing belt 510 in this sequence in the moving direction of the fixing belt 510. The nipping portion N, the thermostat 560, the reflection plate 541, and the heat source 530 are arranged in this sequence along the moving direction of the fixing belt 510.

On the side of the pressure unit 601, the fixing device 500 includes a heat source 630 as a second heat source, a reflection plate 641 serving as a fourth reflection member and a fifth reflection member, a reflection plate 641 serving as a sixth reflection member, a thermistor 650 serving as a temperature detection member, and a thermostat 660 serving as a second temperature detecting member.

The heat source 630 is a heat application source for heating the pressure belt 610. In this embodiment, the heat source 630 has two heaters 631, 632 disposed inside the pressure belt 610. The reason for using the two heaters is to change a heating profile according to a size of the medium 101 in the width direction. Halogen lamps may be used for the heaters 631, 632. The heat source 630 is disposed on a lower side (opposite side to nipping portion) with respect to a maximum outer diameter tangential line of the pressure roller 621. The maximum outer diameter tangential line of the pressure roller 621 means a tangential line on a lower side (opposite side to nipping portion) between two tangential lines of the pressure roller 621 parallel to the nipping reference line when viewed from the rotational axis direction of the pressure roller 621 where the outer diameter of the pressure roller 621 becomes the maximum size in consideration of such as, e.g., thermal expansion. The heat source 630 is disposed between the center of the pressure roller 621 and the center of the pressure roller 622 in the medium conveyance direction. The heat source 630 is disposed so as to radiate the heat in a wider range to an inner surface of the pressure belt 610. The heaters 631, 632 extend along the longitudinal direction of the pressure belt 610, and as shown in FIG. 4, are supported by a heater support portion 678 formed at the pressure roller lever 671 at each end. It is to be noted that the number of the heaters can be one or three or more. The kind of the heater is not limited to the halogen lamp, but such as, e.g., induced heater. As shown in FIG. 2, the heater 630 is connected to the power supply circuit 931 and generates heat upon receiving power supply from the power supply circuit 931.

The reflection plates 641, 642 are members reflecting the heat (or light) from the heat source 630 toward the pressure belt 610. The reflection plates 641, 642 are disposed as facing the heat source 630.

The reflection plate 641 is structured to reflect the heat from the heat source 630 toward a region on an upstream side of the nipping portion N in the moving direction of the pressure belt 610 or in the medium conveyance direction in a range of the pressure belt 610. More specifically, the reflection plate 641 is disposed so as to divide the pressure belt 610, with respect to the rotational direction of the pressure belt 610, into a region 610*x* on an upstream side of the nipping portion N and a region 610*y* on a downstream side of the nipping portion N, and is structured as to reflect the heat from the heat source 630 toward the region 610*x* on the upstream side. The reflection plate 641 is structured so as to reflect the heat more to a portion near the nipping portion N, in the moving direction of the pressure belt 610, in comparison with a situation that no reflection plate is provide. The reflection plate 641 is structured as to reflect the heat from the heat source 630 toward the upstream side in the medium conveyance direction. The reflection plate 641 extends in, e.g., the longitudinal direction of the pressure belt 610, and is secured to the bracket 673 at each end thereof.

The reflection plate 641 is disposed between the heat source 630 and the pressure roller 621 and cuts off the heat from the heat source 630 to the pressure roller 621. More specifically, the reflection plate 641 covers the surface of the pressure roller 621 so that a rubber portion of the pressure roller 621 as a surface layer is not directly exposed to radiation heat emitted from the heat source 630.

The reflection plate 642 is disposed between the heat source 630 and the pressure roller 622 and cuts off the heat from the heat source 630 to pressure roller 622. More specifically, the refection plate 642 covers the surface of the pressure roller 622 so that a rubber portion of the pressure roller 622 as a surface layer is not directly exposed to radiation heat emitted from the heat source 630.

The reflection plates 641, 642 are disposed at positions not contacting the pressure roller 621 and the pressure roller 622 in consideration with such as thermal expansion and rotational vibration of the pressure roller 621 and the pressure roller 622, respectively.

The reflection plates 641, 642 are disposed as separated in the moving direction of the pressure belt 610 and the medium conveyance direction in having a prescribed space, and forms a route 643 introducing the heat from the heat source 630 into the third nipping portion N.

The reflection plate 641 has a reflection surface R3 reflecting the heat from the heat source 630, and a back surface (or namely, non-reflection surface) B3 located on the opposite side of the reflection surface R3. The reflection plate 642 has a reflection surface R4 reflecting the heat from the heat source 630 and a back surface (or namely, non-reflection surface) B4 located on the opposite side of the reflection surface R4.

Referring to FIG. 3, a specific example of the reflection plates 641, 642 is described. The reflection plates 641, 642 are substantially symmetric with the reflection plates 541, 542 with respect to the nipping portion N.

The reflection surface R3 of the reflection plate 641 has four reflection surfaces R3-1 to R3-4, while the reflection surface R4 of the reflection plate 642 has four reflection surfaces R4-1 to R4-4. Each of those reflection surfaces R3-1 to R3-4, R4-1 to R4-4 is in a plane shape.

The reflection surface R3-3 and the reflection surface R4-3 extend in a direction perpendicular to the nipping reference line and are disposed as facing each other. The reflection surface R3-3 and the reflection surface R4-3 are disposed in parallel to each other as to introduce light entering between these surfaces into the nipping portion N upon reflecting the light between these surfaces.

The reflection surface R3-2 is disposed between the heat source 630 and the pressure roller 621. The reflection surface R3-2 extends obliquely downward on a downstream side in the medium conveyance direction from a lower end of the reflection surface R3-3, and is inclined with an angle 45 degrees with respect to the reflection surface R3-3. The reflection surface R3-1 extends downward from an end of the reflection surface R3-2 on a downstream side in the medium conveyance direction. The reflection surface R3-4 extends obliquely upward on a downstream side in the medium conveyance direction from an upper end of the reflection surface R3-3 and is inclined with an angle 45 degrees with respect to the reflection surface R3-3.

The reflection surface R4-2 is disposed between the heat source 630 and the pressure roller 622. The reflection surface R4-2 extends obliquely downward on an upstream side in the medium conveyance direction from a lower end of the reflection surface R4-3, and is inclined with an angle 45 degrees with respect to the reflection surface R4-3. The reflection surface R4-1 extends parallel to the nipping reference line on the upstream side in the medium conveyance direction from an end of the reflection surface R4-2 on the upstream side in the medium conveyance direction, and is inclined with an angle 45 degrees with respect to the reflection surface R4-2. The reflection surface R4-4 extends obliquely upward on an upstream side in the medium conveyance direction from an upper end of the reflection surface R4-3 and is inclined with an angle 45 degrees with respect to the reflection surface R4-3.

The thermistor 650 is a temperature sensor detecting surface temperature of the pressure belt 610, and is used for keeping the surface temperature of the pressure belt 610 at an appropriate temperature for pressure. The thermistor 650 is disposed as facing the pressure belt 610 in a state ensuring a prescribed gap, or namely in a non-contact state with the belt. With the structure that the thermistor is disposed in contact with the surface of the pressure belt, such a thermistor gives damages to the surface of the pressure belt and makes the surface worn as time goes, thereby making those appear on printing images. In this embodiment, the thermistor 650 is disposed in non-contact with the belt, so that such image failure can be avoided. The thermistor 650 is arranged in a region through which media in all sizes handled by the image forming apparatus 1000 can pass. As shown in FIGS. 3, 4, the thermistor 650 is secured to a holder 651. The holder 651 is secured to the lower frame 592. As shown in FIG. 2, the thermistor 650 is connected to the temperature adjustment circuit 911.

The thermostat 660 is disposed in contact with the reflection plate 641, and is a member stopping heat application of the heat source 630 when it is detected that the temperature of the reflection plate 641 reaches a prescribe temperature. The thermostat 660 is provided to prevent the fixing device 500 from extraordinally generating heat. More specifically, the thermostat 660 cuts off the power to the heat source 630 when it is detected that the temperature of the reflection plate 641 reaches a prescribe temperature. As shown in FIG. 2, the thermostat 660 is disposed at an interconnection between the heat source 630 and the power supply circuit 931, and when the temperature of the thermostat 660 reaches a prescribe power cutoff temperature (or operation temperature), the thermostat 660 enters into an open state to cut off the power supply to the heat source 630.

In this embodiment, the thermostat 660 is disposed in contact with the back surface B3 of the reflection plate 641. The thermostat 660 is disposed on the opposite side to the heat source 630 with respect to the reflection plate 641. The thermostat 660 is disposed at a position facing a region of the pressure belt 610 (i.e., region 610*y*) on a downstream side of the nipping portion N in the moving direction of the pressure belt 610. The thermostat 660 is disposed on the downstream side of the heat source 630 in the medium conveyance direction. For example, the thermostat 660 is disposed on a downstream side in the medium conveyance direction as possible with respect to the heat source 630 and at a position at which a heat radiation area to the pressure belt 610 becomes wider as much as possible.

As shown in FIGS. 8, 9, the thermostat 660 is supported by a holder 661 and a thermostat support member 662 in substantially the same manner as that on the fixing unit side. The thermostat 660 is urged by an urging member 663 and is pushed to the back surface B3 of the reflection plate 641 while a heat sensing surface 660*a* projects from an opening 661*a* of the holder 661.

In substantially the same manner as those on the fixing unit side, the thermostat 660 is disposed within a heat generation area of all heaters contained in the heat source 630, or namely within a region in which the heat generation areas of all heaters are overlapping. More specifically, the thermostat 660 is disposed within a region in which the light emitting region of the heater 631 and the light emitting region of the heater 632 overlap each other. The thermostat 660 may be placed at a position at which heat distribution of the heat source 630 becomes the highest amount in the longitudinal direction of the heat source 630. The thermostat 660 is disposed within a region at which media in all sizes handled by the image forming apparatus 1000 can pass, or namely, at which any medium regardless of any size can pass, with respect to the width direction of the media.

Figure 12A:
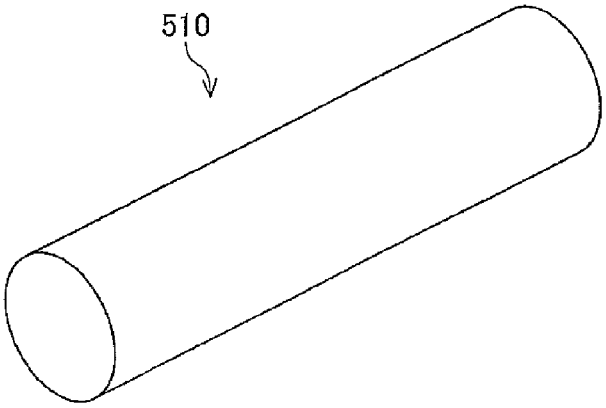
FIGS. 12A, 12B show a structure of a fixing belt.
Figure 12B:
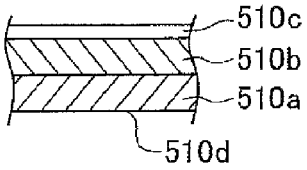

Respective members of the fixing device 500 are described in detail. FIGS. 12A, 12B are a perspective view and a cross-sectional diagram showing a structure of the fixing belt 510. The fixing belt 510 includes a base material 510*a* in an endless form, an elastic layer 510*b* formed on an outer periphery of the base material 510*a*, and a releasing player 510*c* formed on an outer periphery of the elastic layer 510*b*. The base material 510*a* is an endless belt having an elasticity made of a metal such as an SUS (stainless steel). The base material 510*a* has a thickness of approximately 40 to 70 μm, and it is preferable that the base material 510*a* itself has a certain rigidity and a certain flexibility. The elastic layer 510*b* is a silicone rubber layer formed on the base material 510*a*. The releasing layer 510*c* is a fluoric resin layer such as, e.g., PFA, PTFE, and is formed on the elastic layer 510*b* by outserting a tube or by coating a resin. It is to be noted that the releasing layer 510*c* may be formed directly on the base material 510*a* without forming any elastic layer 510*b*. An inner surface 510*d* of the fixing belt 510 is painted in black color to readily absorb radiation heat from the heat source 530. The pressure belt 610 has substantially the same structure as the fixing belt 510.

Figure 13A:
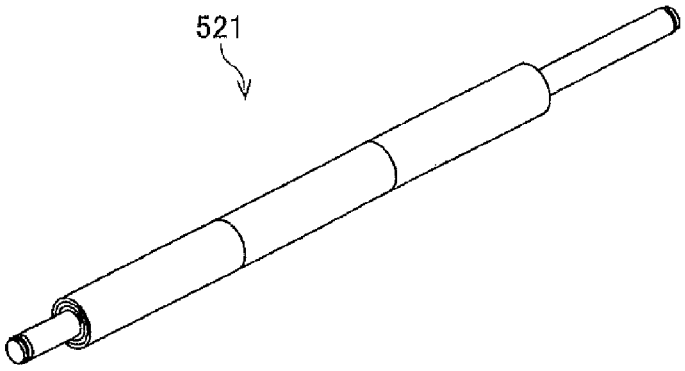
FIGS. 13A, 13B show a structure of a drive roller.
Figure 13B:
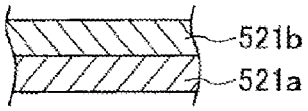

FIGS. 13A, 13B are a perspective view and a cross-sectional diagram showing a structure of the drive roller 521. The drive roller 521 is made as a hollow roller and is formed by covering an elastic layer 521*b* on a core metal 521*a*. In this embodiment, an STKM (carbon steel tube) material is used for the core metal 521*a*. The core metal 521*a* may be formed of other metals such as, e.g., aluminum, unfinished SUM or SUS. In this embodiment, the elastic layer 521*b* may be formed of a solid type silicone rubber having Asker C rubber hardness of 75 to 85 degrees. The pressure roller 621 has substantially the same structure as the drive roller 521. With this structure, the drive roller 521 and the pressure roller 621 facing to each other can have the same heat expansion amount, so that no stress is given to the fixing belt 510 and the pressure roller 610 and so that the nipping portion can be made straight.

Figure 14A:
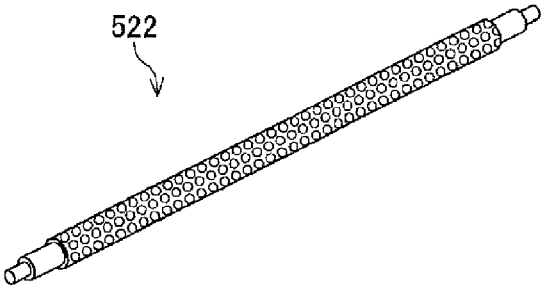
FIGS. 14A, 14B show a structure of a driven roller.
Figure 14B:
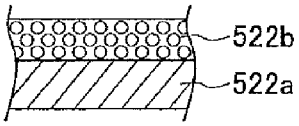

FIGS. 14A, 14B are a perspective view and a cross-sectional diagram showing a structure of the driven roller 522. The driven roller 522 is made to have a smaller diameter than the drive roller 521, and is formed by covering an elastic layer 522*b* on a core metal 522*a*. In this embodiment, used as the core metal 522*a* is a hollow pipe made of an STKM material. The elastic layer 522*b* is formed of a foamed silicone rubber having heat resistance and heat isolation property. The pressure roller 622 has substantially the same structure as the drive roller 522. Accordingly, the driven roller 522 and the pressure roller 622 facing to each other have substantially the same structure, respectively.

Figure 15A:
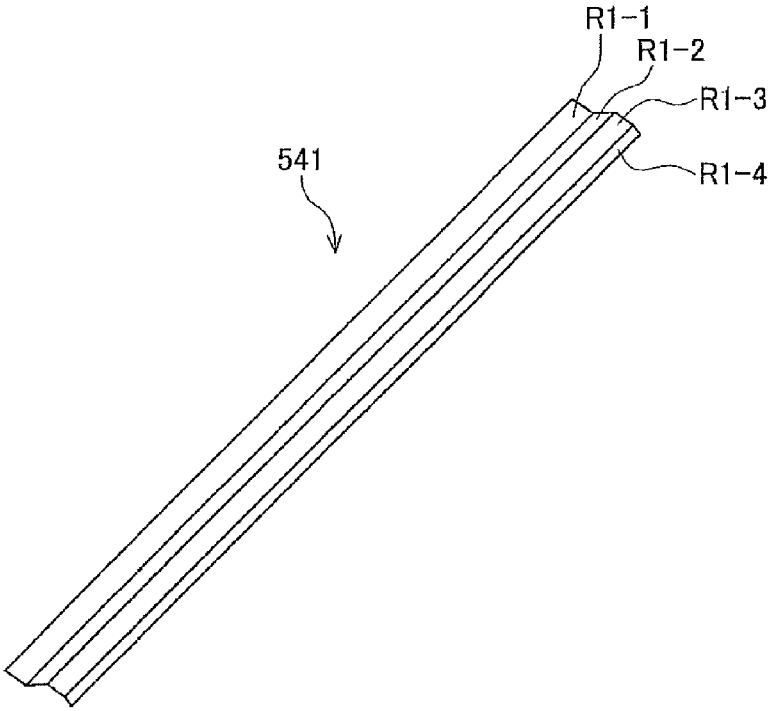
FIGS. 15A, 15B show a structure of a reflection plate.
Figure 15B:
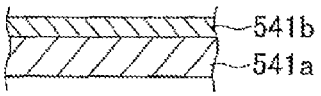

FIGS. 15A, 15B are a perspective view and a cross-sectional diagram showing a structure of the reflection plate 541. The reflection plate 541 has a base material 541*a*, and a reflection layer 541*b* formed on the base material 541*a*. In this embodiment, the base material 541*a* is an aluminum plate, and the reflection layer 541*b* is a highly reflecting aluminum vapored on the base material 541*a*. The reflection layer 541*b* may be formed by vapor deposition of silver on the base material 541*b* to gain a higher reflectivity. Because the reflection plate receives high temperature heat from the halogen lamp, a failure in which the base material of the reflection plate is melt may happen. To prevent such a failure from occurring, possibly used is an SUS304BA plate made of a stainless steel plate having a beautiful glossy surface, which is obtained by shining annealing on a stainless steel plate having a high melting temperature. As such a base material 541*a*, a stainless steel plate obtained by mirror surface polishing of a polishing class of #700 or #800 on a stainless steel plate having a high melting temperature, may be used. For example, a stainless steel plate furnished with polishing of grit sizes #700 to #800 may be used. In such a case, no reflection layer 541*b* is needed, and no vapor deposition is required. The reflection plates 542, 641, 642 have substantially the same structure as the reflection plate 541.

The structure of the reflection member may be changed as appropriate. For example, the first to third reflection members are made of the two reflection plates 541, 542 in this embodiment, but can be made of a single reflection plate. The first to third reflection members may be made of three or more reflection plates, and for example, can be made of three reflection plates corresponding to the first to third reflection members. Although in this embodiment the routes 543, 643 are formed from the reflection members, the reflection member may be structured as to seal a portion of the routes 543, 643.

Next, operation of the fixing device 500 having the structure described above will be described. When printing operation of the image forming apparatus 1000 begins, the control unit 910 begins rotation of the drive roller 521 by controlling the fixing motor 921. With this operation, the drive roller 521 rotates in a direction conveying the medium 101 (Arrow A5 direction in FIG. 3). The fixing belt 510 is driven by the drive roller 521 with frictional force occurring between the belt and the drive roller 521 according to rotation of the drive roller 521, and proceeds in a prescribed direction (Arrow A4 direction in FIG. 3). The rotation of the fixing belt 510 is transmitted to the driven roller 522, and the driven roller 522 is driven to rotate in the direction conveying the medium 101 (Arrow A7 direction in FIG. 3) according to the rotation of the fixing belt 510. The rotation of the fixing belt 510 is transmitted to the surface of the pressure roller 610 at the first nipping portion N1 formed between the drive roller 521 and the pressure roller 621. The pressure belt 610 thus rotates the peripheries of the pressure rollers 621, 622 in a driven manner in the direction conveying the medium 101 (Arrow A6 direction in FIG. 3) at the same rate as the fixing belt 510 according to the rotation of the fixing belt 510. The rotation of the pressure belt 610 is transmitted to the pressure rollers 621, 622, and the pressure rollers 621, 622 are driven to rotate in the direction conveying the medium 101 (Arrows A8, A9 direction in FIG. 3) according to the rotation of the pressure belt 610.

As shown in FIG. 3, the fixing belt 510 and the pressure belt 610 are mounted at non-nipping portion in a loosen fashion, and rotate in keeping the loosen state because the base material has an elasticity.

The control unit 910 begins current supply to the heaters 531, 532 from the power supply circuit 931. With this operation, the heaters 531, 532 generate heat, and the fixing belt 510 is heated from the interior. The surface of the heated fixing belt 510 is detected with the thermistor 550, and the surface temperature information indicating the surface temperature is entered to the temperature adjustment circuit 911 of the control unit 910 from the thermistor 550. The temperature adjustment circuit 911 controls the current supply to the heater 531, 532 from the power supply circuit 931 based on the surface temperature information from the thermistor 550, thereby keeping the surface temperature of the fixing belt 510 at a prescribed fixing temperature.

The control unit 910 similarly begins current supply to the heaters 631, 632 from the power supply circuit 931. With this operation, the heaters 631, 632 generate heat, and the pressure belt 610 is heated from the interior. The surface of the heated pressure belt 610 is detected with the thermistor 650, and the surface temperature information indicating the surface temperature is entered to the temperature adjustment circuit 911 of the control unit 910 from the thermistor 650. The temperature adjustment circuit 911 controls the current supply to the heater 631, 632 from the power supply circuit 931 based on the surface temperature information from the thermistor 650, thereby keeping the surface temperature of the pressure belt 610 at a prescribed fixing temperature.

Figure 16:
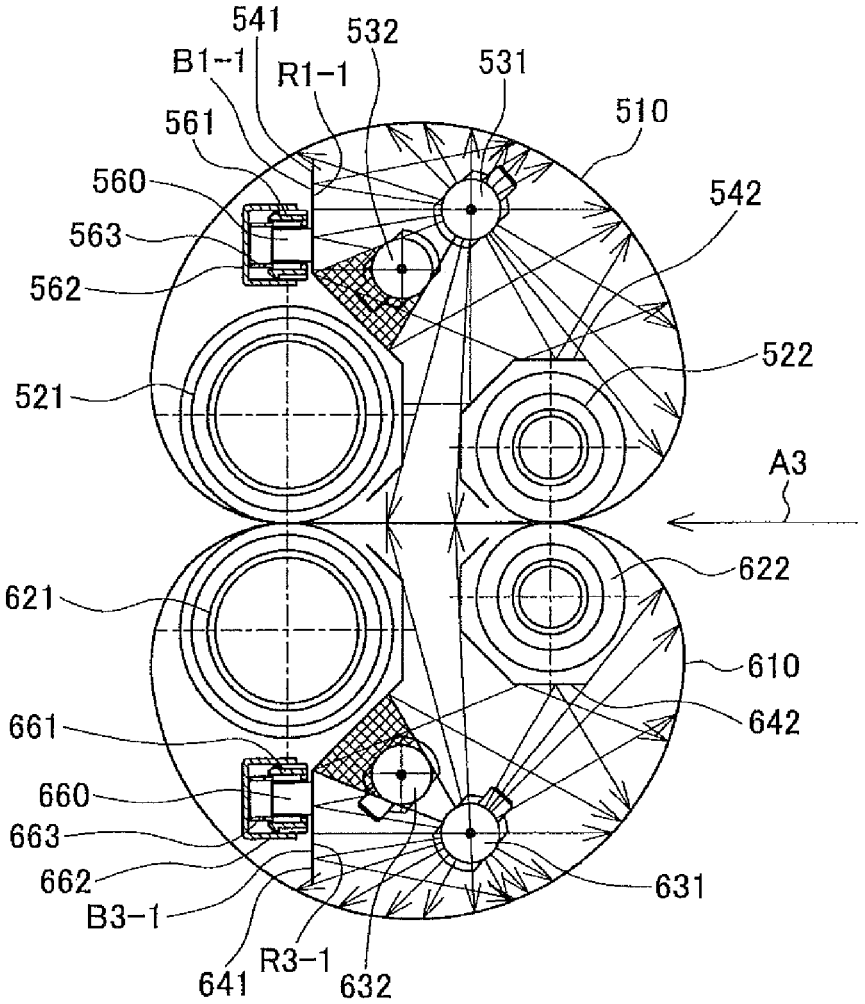
FIG. 16 is a cross-sectional diagram showing light radiation directions of the heater.
Figure 17:
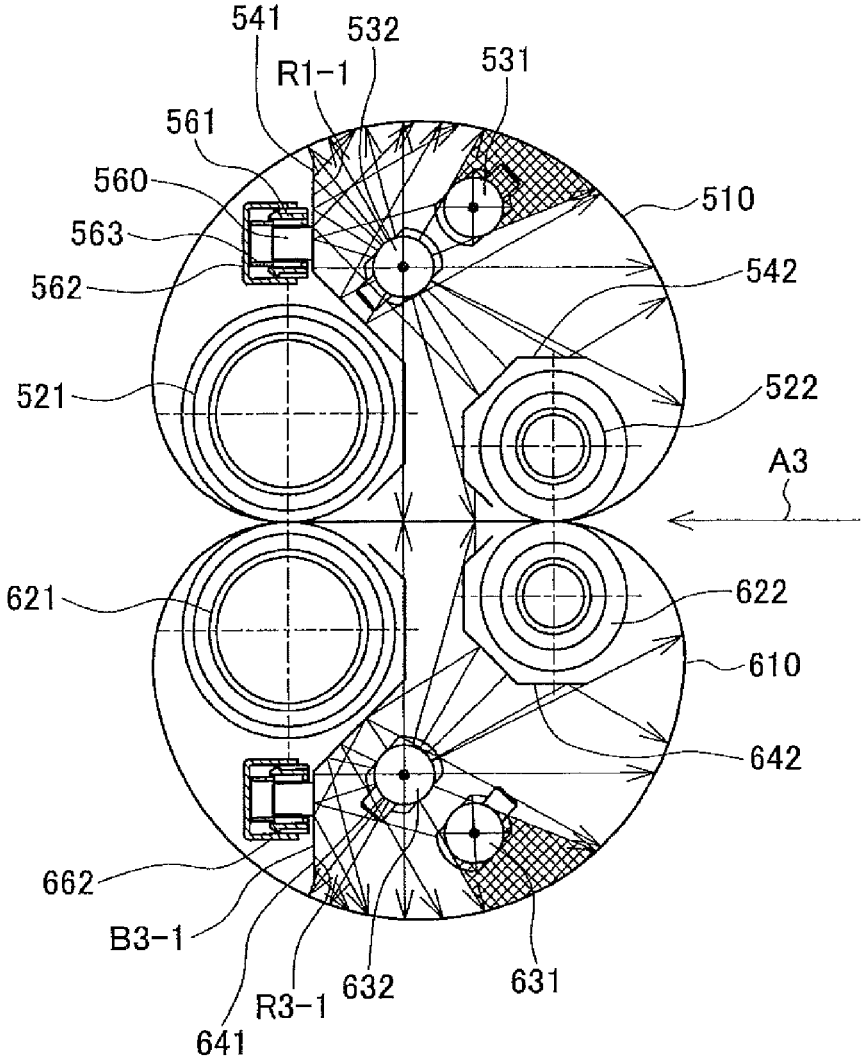
FIG. 17 is a cross-sectional diagram showing light radiation directions of the heater.

FIG. 16 shows light radiation directions of the heaters 531, 631 when the heaters 531, 631 emit light. FIG. 17 shows light radiation directions of the heaters 532, 632 when both of the heaters 532, 632 emit light.

In FIG. 16, the light emitted from the heater 531 spread out radially, thereby supplying heat to the inner surface of the fixing belt 510. In this embodiment, the heater 531 is disposed more on the upstream side in the medium conveyance direction than the heater 532, so that the light of the heater 531 is not radiated to an area on a downstream side in the medium conveyance direction (or namely a cross hatching region in the fixing belt 510 in FIG. 16), as a shadow of the heater 532. In substantially the same manner, the light emitted from the heater 631 spread out radially, thereby supplying heat to the inner surface of the pressure belt 610. In this embodiment, the heater 631 is disposed more on the upstream side in the medium conveyance direction than the heater 632, so that the light of the heater 631 is not radiated to an area on a downstream side in the medium conveyance direction (or namely a cross hatching region in the pressure belt 610 in FIG. 16), as a shadow of the heater 632.

In FIG. 17, the light emitted from the heater 532 spread out radially, thereby supplying heat to the inner surface of the fixing belt 510. In this embodiment, the heater 532 is disposed more on the downstream side in the medium conveyance direction than the heater 531, so that the light of the heater 532 is not radiated to an area on an upstream side in the medium conveyance direction (or namely a cross hatching region in the fixing belt 510 in FIG. 17), as a shadow of the heater 531. In substantially the same manner, the light emitted from the heater 632 spread out radially, thereby supplying heat to the inner surface of the pressure belt 610. In this embodiment, the heater 632 is disposed more on the downstream side in the medium conveyance direction than the heater 631, so that the light of the heater 632 is not radiated to an area on an upstream side in the medium conveyance direction (or namely a cross hatching region in the pressure belt 610 in FIG. 17), as a shadow of the heater 631.

The light from the heaters 531, 532 is directly radiated to the reflection surface R1-1 of the reflection plate 541. If the light is absorbed so much to the reflection surface R1-1, the reflection surface R1-1 becomes very high temperature. Because the radiated light is actually reflected so much by the reflection surface R1-1, the reflection surface R1-1 keeps a low temperature suppressed to some extent. The reflection plate 541 has the substantial thickness, so that the back surface B1-1 on the opposite side of the reflection surface R1-1 is suppressed to have a further lower temperature. Accordingly, even where the power supply cutoff temperature of the used thermostat 560 is low, the heat sensing surface 560*a* of the thermostat 560 is disposed in contact with the back surface B1-1. In the same way, on the side of the pressure unit, the back surface B3-1 on the opposite side of the reflection surface R3-1 is suppressed to have a lower temperature, so that the heat sensing surface 660*a* of the thermostat 660 is disposed in contact with the back surface B3-1.

Figure 18:
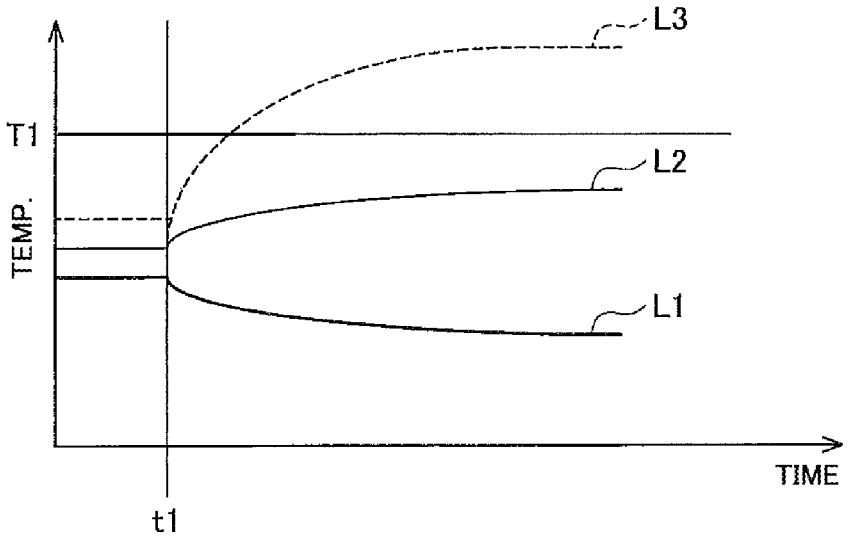
FIG. 18 is a diagram showing a relationship among surface temperature of the fixing belt, temperature of a reflection surface of the reflection plate, and temperature of a back surface of the reflection plate.

FIG. 18 is a diagram showing a relationship among surface temperature of the fixing belt 510, temperature of the reflection surface R1-1 of the reflection plate 541, and temperature of the back surface B1-1 of the reflection plate. 541. In FIG. 18, the abscissa indicates time whereas the ordinate indicates temperature. A thick solid line L1 indicates the surface temperature of the fixing belt 510; a fine solid line L2 indicates the temperature of the back surface B1-1; a broken line L3 indicates the temperature of the reflection surface R1-1. The temperature T1 is the power supply cutoff temperature of the thermostat 560.

The image forming apparatus 1000 is in a waiting state at a time previous to timing t1. At that time, the reflection surface R1-1 of the reflection plate 541 receiving directly the light from the heaters indicates the highest temperature; the back surface B1-1 with which the thermostat 660 is disposed in contact, indicates the second highest temperature; the surface temperature of the fixing belt 510 indicates the lowest.

If successive printing starts at timing t1, the media 101 carrying unfixed toner images are successively conveyed to the fixing device 500 from the image forming unit 400, and pass by the nipping portion N. The heat of the fixing belt 510 is supplied to the media 101 at that time. With this operation, if the detection temperature of the thermistor 550 is lowered, the temperature adjustment circuit 911 increases the power supply to the heaters 531, 532. For example, the temperature adjustment circuit 911 increases light emission duty for light emission control of the halogen lamp. This operation increases the heat amount supplied to the fixing belt 510 from the heaters 531, 532. In the example in FIG. 18, however, the heat amount supplied from the heaters 531, 532 to the fixing belt 510 is smaller than the heat amount supplied from the fixing belt 510 to the media 101, so that the surface temperature of the fixing belt 510 indicates a decreasing tendency during a period right after timing t1. Then, the heat amount dissipated from the fixing belt 510 and the heat amount given to the fixing belt 510 become balancing, and the fixing belt 510 comes to have a constant surface temperature.

To the contrary, with respect to the reflection plate 541, the heat radiated from the heat source 530 increases according to increased power supply to the heaters 531, 532 after timing t1, so that the reflection surface R1-1 and the back surface B1-1 indicate higher temperatures and reach saturation temperatures, respectively. The saturation temperature of the reflection surface R1-1 is higher than the power supply cutoff temperature of the thermostat 560, but the saturation temperature T1 of the back surface B1-1 is lower than the power supply cutoff temperature T1 of the thermostat 560.

In substantially the same way, on the side of the pressure unit, temperature order is, from the highest, the reflection surface R3-1, the back surface B3-1, and the pressure belt 610. The saturation temperature of the reflection surface R3-1 is higher than the power supply cutoff temperature of the thermostat 660, but the saturation temperature of the back surface B3-1 is lower than the power supply cutoff temperature of the thermostat 660.

As shown in FIG. 16, the light radiated to the reflection surface R1-1 of the reflection plate 541 is reflected toward the upstream side in the medium conveyance direction according to the relation between incident angle and reflection angle. Similarly, the light radiated to the reflection surface R3-1 of the reflection plate 641 is reflected toward the upstream side in the medium conveyance direction.

According to the embodiment described, the following advantages can be obtained. First, in this embodiment, the thermostat 560 serving as the temperature detecting member is disposed in contact with the reflection plate 541 as a member heated by the heat source 530. Therefore, the temperature of the member heated by the heat source can be detected accurately in comparison with the structure in which the thermostat is disposed in non-contact with a member heated by the heat source 530, such as, e.g., a belt. In other words, because the thermostat is disposed in contact with the member heated by the heat source, the temperature of the member heated by the heat source can be detected with higher detection accuracy in comparison with the structure in which the thermostat is disposed in non-contact with a member heated by the heat source, and the thermostat can have a higher detection accuracy. More specifically, temperature deviations due to deviations of the gap between the thermostat and the belt can be excluded, and the temperature can be detected with tolerance of the thermostat. With this structure, it can be detected accurately that the temperature of the member heated by the heat source reaches the prescribed extraordinary temperature or excessive temperature rise of the fixing device, so that the power supply to the heat source can be cut off properly, and a safer fixing device can be provided The gap between the thermostat and the belt is no longer required to be managed. Because the thermostat 560 is disposed in non-contact with the fixing belt 510, the fixing belt 510 is prevented from being damaged or worn, so that image quality can be assured in a further stable manner.

Second, the thermostat 560 is disposed in contact with the reflection surface 541*a* of the reflection plate 541 and the back surface 541*b* on the opposite side. According to this structure, it can be prevented that the heat from the heat source 530 is directly radiated to the thermostat 560. The reflection plate 541 is prevented from excessively raising its temperature by reflecting the heat from the heat source 530. With this structure, a thermostat having a low power supply cutoff temperature is usable, and costs for the device can be reduced.

Third, the reflection plate 541 reflects the heat from the heat source 530 toward the area on the upstream side of the nipping portion N in the moving direction of the fixing belt 510 in the fixing belt 510. With this structure, the heat radiated toward the reflection plate 541 can be radiated to the area on the upstream side of the nipping portion N, so that the fixing belt 510 can be heated efficiently. More specifically, heat dissipation during conveyance of the fixing belt 510 can be reduced by heating the area on the upstream side of the nipping portion N, thereby providing heat to the conveyed media 101 efficiently. This ensures shortened time for warming up, excellent fixing nature, and stable fixing quality.

Fourth, the thermostat 560 is disposed as facing the area on the downstream side of the nipping portion N in the moving direction of the fixing belt 510 in the fixing belt 510. With this structure, the thermostat 560 faces a region having a relatively low temperature in the fixing belt 510. Accordingly, this structure can reduce affection from the temperature of the fixing belt 510 to the thermostat 560.

Fifth, the thermostat 560 can reduce mounting volume of the fixing device 500 because disposed inside the fixing belt 510.

Sixth, the thermostat 560 may be disposed at a center portion in the longitudinal direction of the reflection plate 541 serving as a first reflection member. The center portion means a range of 10% or less of the longitudinal direction of the reflection plate 541 as a deviation from the center in longitudinal direction of the reflection plate 541. This fixing device can detect further accurate temperature by providing the thermostat 560 at the center portion because the heat dissipate less to the exterior from the center portion of the reflection plate 541 in comparison with each end in the longitudinal direction of the reflection plate 541.

It is to be noted that the invention is not limited to the above described embodiment, and can be employed with various features as far as not deviated from the spirits of the invention.

For example, in the above embodiment, the structure having the heat source 530 heating the fixing belt 510 and the heat source 630 heating the pressure belt 610 is exemplified, but the structure may work if having at least a heat source for heating fixing belt 510, and the heat source 630 of the pressure belt 610 may be omitted. In such a situation, the reflection plates 641, 642, the thermistor 650, and the thermostat 660 can be omitted.

The number of the rollers contained in the fixing device 500 can be changed properly. For example, the roller number contained in the fixing unit 501, as well as the roller number contained in the pressure unit 601 may be one or three or more. The respective rollers in the fixing device 500 can be changed to other members such as pads. The fixing belt 510 can be conveyed with a member or members other than the drive roller 521.

In the above embodiment, the structure having the belts arranged at upper and lower locations, respectively, but the device may have at least one belt, and the number or position of the belt can be changed. For example, the pressure unit 601 may be without any pressure belt 610, and may have one or more pressure rollers directly contacting the fixing belt 510. The device may have a structure with the fixing belt 510 disposed on a lower side and the pressure unit 601 disposed on an upper side. In such a structure, the pressure unit 601 may or may not have a pressure belt 610.

Although the structure having the medium proceeding reference at end thereof is exemplified in the above embodiment, the medium proceeding reference may be located at a center. The heat generation patterns of the heaters, as well as the number and positions of the thermostat may be changed appropriately.

Although the fixing device of the electrophotographic printer is exemplified in the above embodiment, the invention is applicable to the fixing device of the image forming apparatuses of other types such as, e.g., photocopiers, facsimile machines, and MFPs (multi-function peripherals).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A fixing device for fixing a developer image on a recording medium conveyed in a prescribed direction, the fixing device comprising:

a first belt in an endless form;

a first heat source for heating the first belt;

a first roller disposed at an inner peripheral surface of the first belt;

a second roller disposed at the inner peripheral surface of the first belt and at an upstream region of the first roller in the prescribed direction;

a first reflection member, disposed between the first roller and the first heat source, the first reflection member reflecting heat from the first heat source toward the first belt;

a second reflection member disposed between the second roller and the first heat source at the upstream region of the first reflection member in the prescribed direction, the second reflection member reflecting heat from the first heat source toward the first belt;

a first temperature detecting member for detecting temperature of the first reflection member by contacting the first reflection member;

a pressure unit for contacting with pressure to the first roller and the second roller through the first belt, wherein the pressure unit forms a nipping portion with the first roller, the second roller, and the first belt, wherein the first reflection member includes:

a first reflection surface, reflecting heat toward an upstream region in the prescribed direction;

a second reflection surface, extending linearly toward the nipping portion from one end of the first reflection surface; and a third reflection surface, extending substantially parallel to the second reflection surface from the other end of the first reflection surface, wherein the second reflection member includes:

a fourth reflection surface, reflecting heat toward a downstream region in the prescribed direction; and a fifth reflection surface, extending linearly toward the nipping portion from one end of the fourth reflection surface, wherein the second reflection surface and the fifth reflection surface form a route parallel thereto, extending toward the nipping portion for transmitting heat to the nipping portion, and wherein the first temperature detecting member contacts a rear surface of the third reflection surface.

2. The fixing device according to claim 1, wherein one of the reflection surfaces of the first reflection member reflects heat from the first heat source.

3. The fixing device according to claim 1, wherein the first heat source, the first reflection member, and the first temperature detecting member are disposed inside the first belt.

4. The fixing device according to claim 1, wherein the first temperature detecting member is disposed in contact with the first reflection member for ceasing heating from the first heat source when in a case where detecting that a temperature of the first reflection member reaches a prescribed temperature.

5. The fixing device according to claim 1, wherein the first temperature detecting member is a thermostat cutting off a current to the first heat source when detecting the temperature of the first reflection member reaches a prescribed temperature.

6. The fixing device according to claim 1, wherein the first reflection member is made of any of an SUS304BA plate, a stainless plate finished with mirror surface polishing of #700 to #800, an aluminum plate having a deposited reflection layer made of high reflection aluminum, and a silver deposited aluminum plate.

7. The fixing device according to claim 1, wherein the first belt has a base material made of an elastic endless metal belt.

8. The fixing device according to claim 1, wherein an outer diameter of the first roller is formed to be larger than that of the second roller, wherein the first temperature detecting member is disposed vertically above the first roller, and wherein the first heat source is disposed at the upstream region of the first roller in the prescribed direction, and is disposed vertically above the first roller.

9. The fixing device according to claim 1, wherein the pressure unit includes:

a second belt in an endless form for contacting the first belt;

a third roller for contacting with pressure to the first roller through the first belt and the second belt; and a fourth roller disposed at an upstream region of the third roller in the prescribed direction, the fourth roller contacting with pressure to the second roller through the first belt and the second belt.

10. The fixing device according to claim 1, wherein the first roller has an elastic layer on a surface layer thereof, and wherein the second roller has an elastic layer on a surface layer thereof.

11. The fixing device according to claim 1, wherein the second reflection member has a sixth reflection surface extending in substantially parallel in the prescribed direction from the other end of the fourth reflection surface.

12. An image forming apparatus comprising:

an image forming section for forming a developer image on a recording medium; and a fixing device according to claim 1 for fixing, to the recording medium, the developer image formed on the recording medium.

* * * * *